US006783146B1

(12) United States Patent
Coing

(10) Patent No.: US 6,783,146 B1
(45) Date of Patent: Aug. 31, 2004

(54) DEVICE PROVIDING A CONNECTION BETWEEN A BOOT BINDING AND A SNOWBOARD

(75) Inventor: Patrice Coing, Meylan (FR)

(73) Assignee: Emery S.A., Saint Egreve (FR)

( * ) Notice: Subject to any disclaimer, the term of this patent is extended or adjusted under 35 U.S.C. 154(b) by 278 days.

(21) Appl. No.: 09/722,046

(22) Filed: Nov. 27, 2000

(30) Foreign Application Priority Data

Dec. 13, 1999 (FR) ..... 99 15657

(51) Int. Cl.[7] ..... A63C 9/02

(52) U.S. Cl. ..... 280/618; 248/292.12; 248/349.1; 280/633; 280/14.24

(58) Field of Search ..... 248/349.1, 346.01, 248/285.1, 292.12; 280/607, 617, 618, 633, 634, 14.21, 14.22, 14.24

(56) References Cited

U.S. PATENT DOCUMENTS 5,236,216 A * 8/1993 Ratzek ..... 280/618
5,890,730 A * 4/1999 Anderson et al. ..... 280/14.22
5,941,552 A * 8/1999 Beran ..... 280/14.21
5,947,488 A * 9/1999 Gorza et al. ..... 280/14.21
5,957,479 A * 9/1999 Bayer et al. ..... 280/14.21
5,967,542 A 10/1999 Wenhao et al.

FOREIGN PATENT DOCUMENTS

| | | |
|---|---|---|
| FR | 2669237 | 5/1992 |
| FR | 2736842 | 1/1997 |
| FR | 2755025 | 4/1998 |
| JP | 11-197287 | 7/1997 |

* cited by examiner

*Primary Examiner*—Michael Mar
(74) *Attorney, Agent, or Firm*—Bugnion S.A.; John Moetteli

(57) ABSTRACT

The connecting device consists of a circular disk (7) fixed to the snowboard and fitting into a circular ring (8) holding the binding (1) on the board. The interior circular contour (11) of the ring into which the disk fits is eccentric relative to the exterior contour of the ring. The mechanical continuity provided by the ring guarantees that the binding will be held in position without high pressure needing to be exerted on this ring.

7 Claims, 4 Drawing Sheets

DEVICE PROVIDING A CONNECTION BETWEEN A BOOT BINDING AND A SNOWBOARD

FIELD OF THE INVENTION

The present invention relates to a device providing a connection between a boot binding and a sliding board, particularly a snowboard, comprising means for adjusting the position of the binding relative to the snowboard both in terms of translation and in terms of rotation.

PRIOR ART

As explained in patent FR 2 736 842, the content of which is incorporated by reference, the positions adopted for board riding vary greatly according to the discipline being practiced, the level of ability or the habit of the user. As is explained in that document, the feet may be closer together or farther apart or may be more or less inclined with respect to the longitudinal axis of the board, the orientations of the feet generally being not mutually parallel. For fuller details, reference may be made to that document. It is therefore important to be able to alter the position of the bindings on the board and the orientation of these bindings relative to the board.

Document FR 2 736 842proposes, for this purpose, an interface which is intended to be mounted between the board and the binding, this interface comprising two rails shaped as slideways and inserted longitudinally in the board along its longitudinal axis and two mounting plates equipped with a slider capable of running in the rails and which can be angularly oriented about a vertical axis, quick-clamping means allowing the mounting plates to be immobilized on the board. Each mounting plate has four threaded holes for fixing the base of the boot binding, these four holes replacing the insert found in standard boards. An interface such as this has the advantage of quick adjustment but requires a special board, the rigidity of which is increased by the insertion of the rails, these rails in any event altering the dynamic behavior of the board. An interface such as this also has a significant weight. In spite of this, such an interface does not offer the possibility of adjusting the position of the binding by movement in a direction transverse to the longitudinal axis of the board, although such "fore-aft" adjustment is becoming increasingly in demand by the users.

Patent FR 2755 025, the content of which is incorporated by reference, also discloses a device providing a connection between a snowboard and a boot binding, this connecting device comprising a mounting plate intended to be fixed by means of screws into the standard (4×4) inserts of a snowboard, this mounting plate having grooves parallel to the longitudinal axis of the board and having a T-profile in which are mounted gib nuts for securing the base of the boot binding, which binding is of the type that can be oriented about a central disk in the example described. This construction has the advantage that it can be adapted to any standard board, that is to say to any board equipped with inserts in the customary 4 ×4configuration, but it still does not allow "fore-aft" adjustment.

A connecting device that does allow "fore-aft" adjustment is described in Japanese patent application 11-197287, the content of which is incorporated by reference. The base of the binding is held by the stack of a perforated disk, a plate with four oblong holes or slots and a rectangular plate holding everything on the snowboard by four screws. To adjust the orientation of the binding, the stack is simply slackened. The intermediate plate can move in just one direction relative to the disk, along a graduated scale, but its oblong holes, oriented at right angles to its direction of travel, allow it to move relative to the upper plate, allowing "fore-aft" adjustment. This construction is equivalent to a simplified construction simply employing a perforated disk and a holding plate. In any event, a significant amount of space is needed, in the plane of the disk between the interior edge of the disk and the plate which holds it, to provide this adjustment, and the disk is held, parallel to its plane, only by the forces of friction generated by the tightening of the screws. These forces may prove insufficient to hold the binding in the event of sudden and relatively high loadings exerted on the connection, as occurs when snowboarding. In addition, given the loadings that the perforated disk has to withstand, this disk can hardly be made of plastic.

SUMMARY OF THE INVENTION

The object of the invention is to produce a simple and compact connecting device with multi-directional adjustment and which very reliably holds the boot binding in place in a plane parallel to the snowboard.

The connecting device according to the invention is one which consists of a circular disk intended to be fixed to the snowboard and to fit into a circular ring intended to hold the boot binding on the snowboard, the interior circular contour of the ring into which the disk fits being eccentric relative to the exterior contour of the ring.

The ring provides mechanical continuity between the base of the binding and the disk. This continuity and the relatively small eccentricity make it practically impossible for the binding to shift even if the fixing screws are slackened. The disk and the ring may advantageously be made of plastic, which reduces their weight by comparison with an embodiment in metal.

The amount of adjustment in a direction transverse to the longitudinal axis of the board is largely sufficient for the requirements. As far as adjustment along the longitudinal axis of the board is concerned, the amount in this direction may be increased if necessary by using a disk with parallel oblong holes for the passage of the screws for fixing to the board.

Adjustment using the eccentric ring may be continuous but, in this case, one of the securing methods guarding against relative rotation of the disk and the ring or of the ring and the fixing base will be simply by friction. It is preferable to adopt an almost continuous adjustment using sets of teeth between, on the one hand, the disk and the ring and, on the other hand, the ring and the fixing base. Of course, one of the connections could be by sets of teeth and the other by friction.

BRIEF DESCRIPTION OF THE DRAWINGS

The appended drawing depicts, by way of example, one embodiment of the invention.

DESCRIPTION OF THE PREFERRED EMBODIMENT

Figure 1:
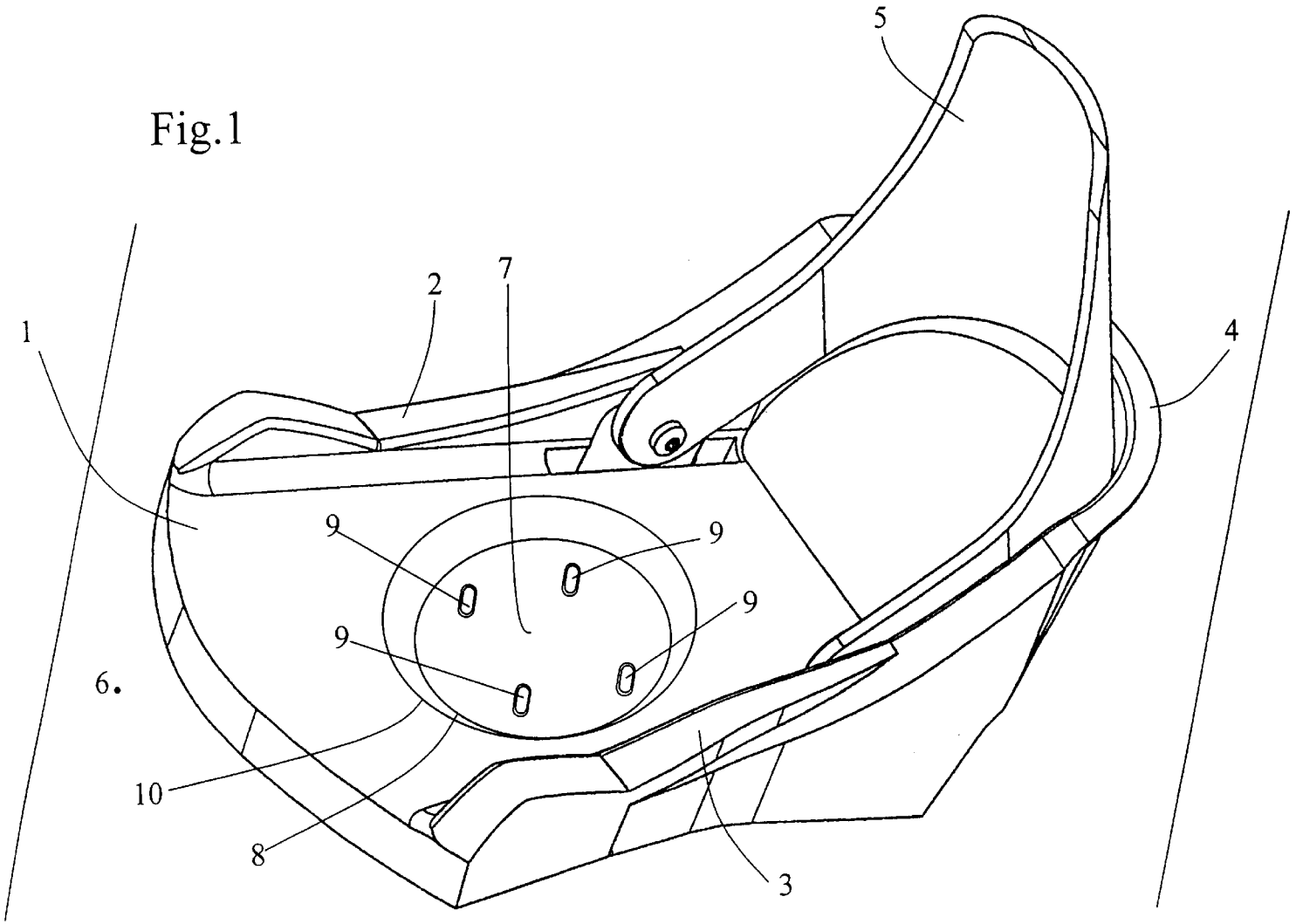
FIG. 1 is a perspective view of a snowboard binding base mounted on a snowboard using a device according to the invention.

The binding depicted partially in FIG. 1 comprises a flat base 1 with two essentially vertical lateral walls 2 and 3 connected at the rear by a bow 4. Articulated in the known way to the lateral walls 2 and 3, and inside the latter, is a rear support piece 5 of rounded shape. Also, extending between the walls 2 and 3 are two straps, not depicted, with buckles, for holding the boot in the binding in the known way.

The boot binding is secured to a snowboard 6 by means of a connecting device consisting of a circular disk 7 and of a ring 8. The disk 7 has four oblong holes 9 arranged in a square to fix the disk 9 to the board 6, in this particular instance a snowboard equipped with threaded inserts also arranged in a square in the customary 4 ×4configuration. The ring 8 is also circular and it is engaged in a circular cutout 10 in the base 1.

Figure 2:
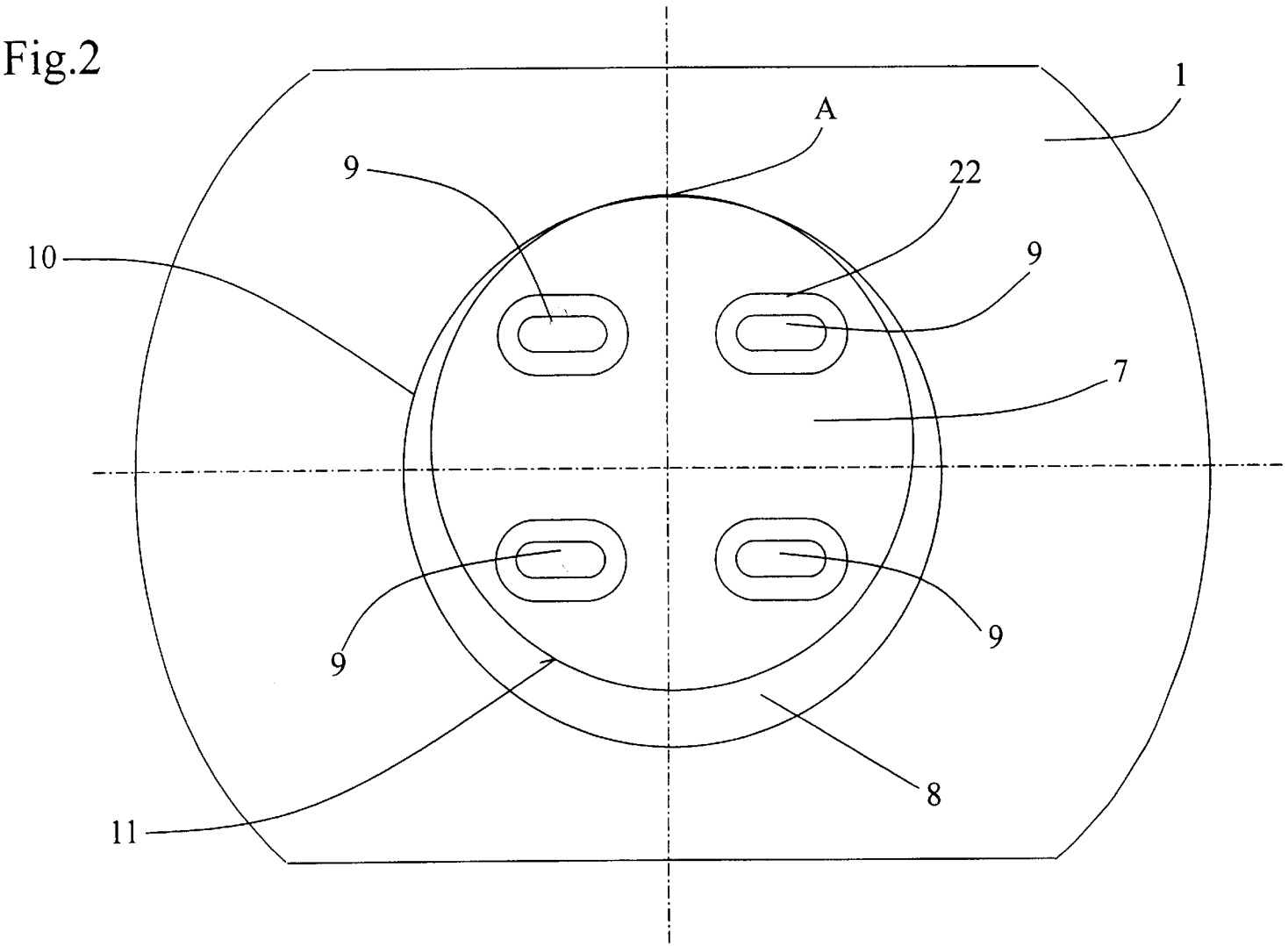
FIG. 2 is a partial plan view, from above, of the binding depicted in FIG. 1.
Figure 3:
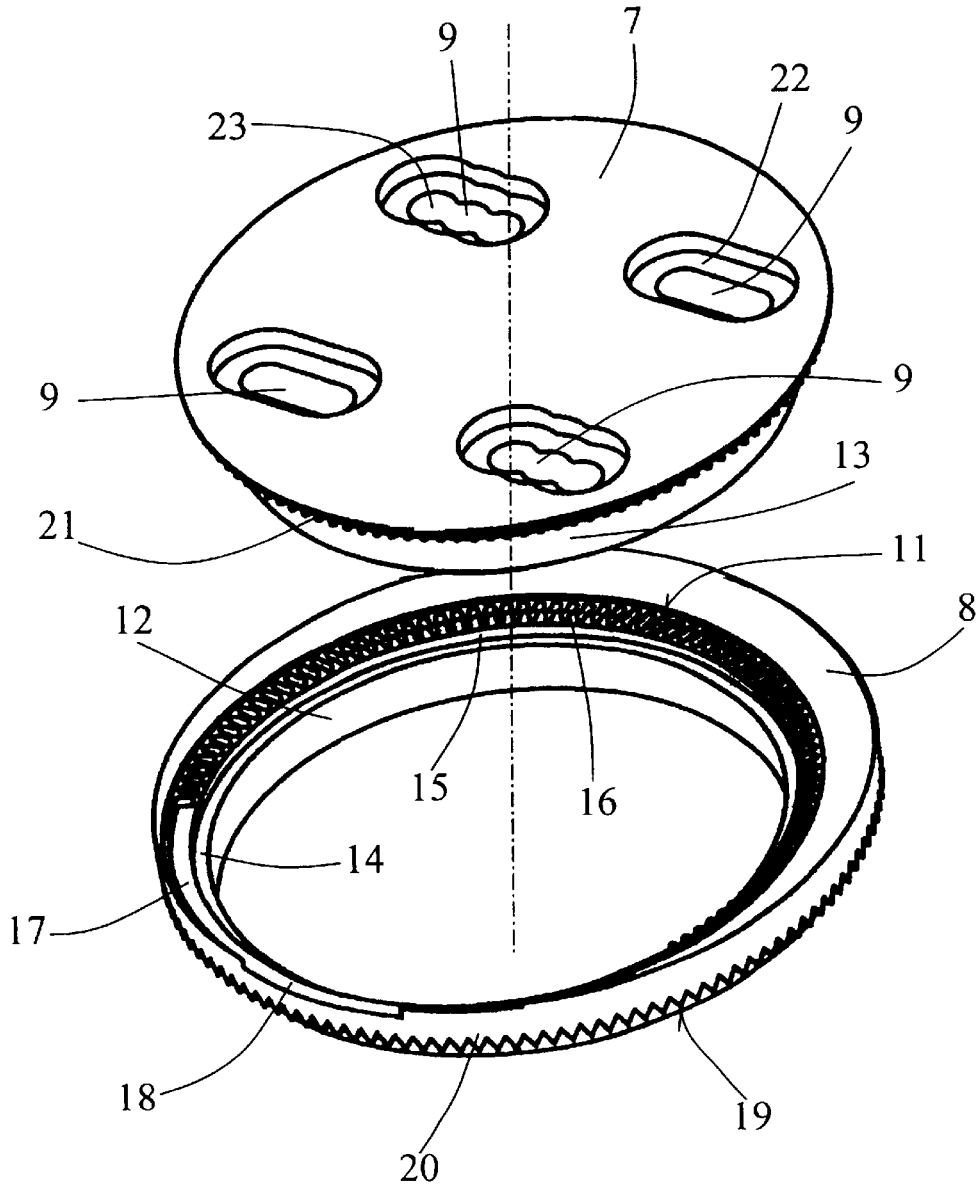
FIG. 3 is an exploded view of the disk and of the ring.

Over about the upper half of its thickness, the ring 8 has a circular interior contour 11 which is eccentric relative to its exterior contour and this eccentricity is such that the interior and exterior contours have a point of tangency A (FIG. 2). Over the remainder of its thickness, the ring 8 has a cylindrical part 12 concentric with the circle 11 but of a smaller inside diameter, defining a cylindrical zone of fitment for a corresponding cylindrical part 13 of the disk 7 (FIG. 3). The wall 12 defines a first flat bearing surface 14 about mid-way up the ring 8. Above this bearing surface 14 there extends a second bearing surface 15 in which an edge-on set of teeth 16 is formed. The drawing clearly shows a zone free of teeth 17, whose purpose is simply to make the ring thinner in this zone. On the side, the ring 8 also has a notch 18 to make the disk 7 and the ring 8 easier to separate. On the outside, the ring 8, in the lower half of its height, has a part 19 of a diameter smaller than the exterior contour of the ring and forming a part that fits into the cutout, of corresponding diameter, in the base 1. The latter cutout extends over about the lower half of the thickness of the base 1, defining a toothed bearing surface into which an edge-on set of teeth 20 of the ring 8 corresponding to the teeth in the base engage.

On its lower face, the disk 7 has an edge-on set of teeth 21 which engages in the set of teeth 16 of the ring 8.

The oblong holes 9 of the disk 7 are counterbored 22 to take the heads of the screws that fix the disk 7 to the snowboard. Two of the holes 9 visible in FIG. 3 differ slightly from the holes 9 depicted in FIG. 2 in that they have two narrowings defining three discrete portions in the fixing screws.

The set of teeth 20 collaborating with the set of teeth of the board 6 allows the boot binding to be oriented relative to the longitudinal axis of the board, in the known way.

Figure 4:
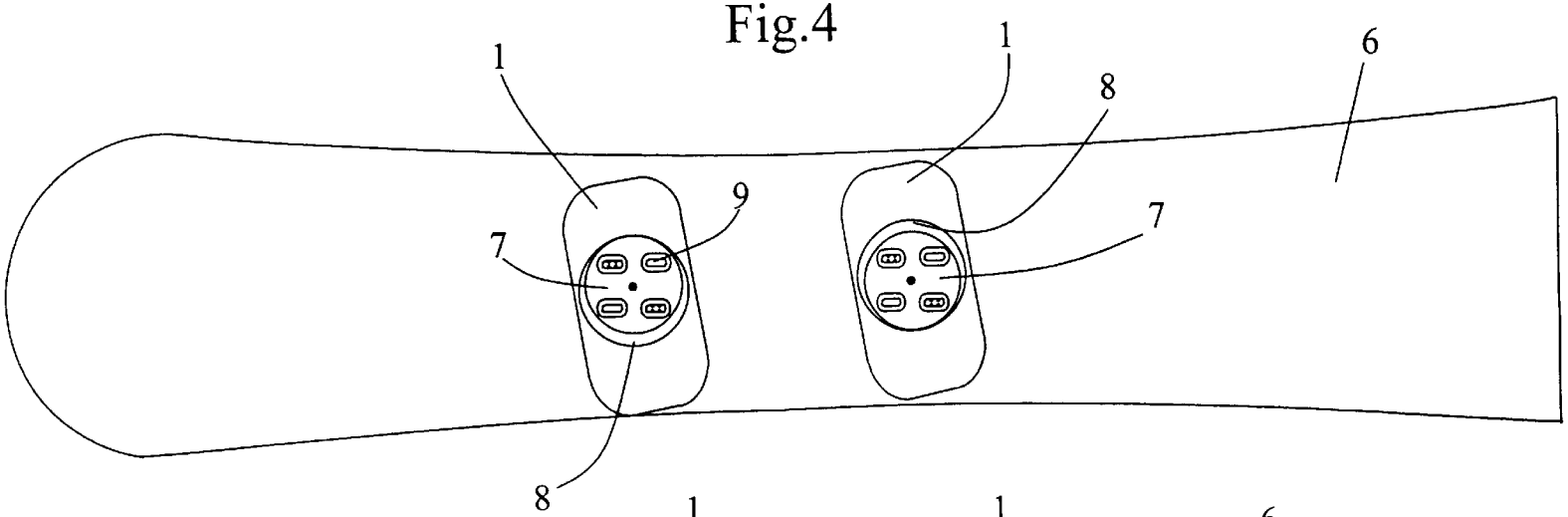
FIG. 4 illustrates the possibility for fore-aft adjustment on a snowboard.
Figure 5:
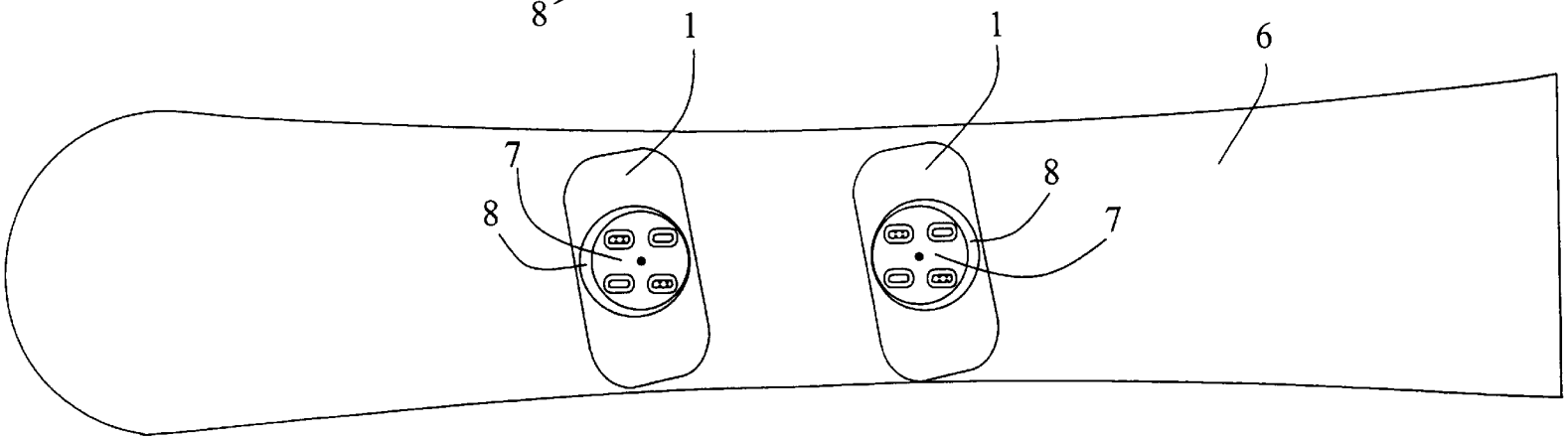
FIG. 5 illustrates the possibility of adjustment along the longitudinal axis of the snowboard.

The ring 8 allows the binding to be shifted relative to the disk 7, that is to say to the board 6, in practically all directions as illustrated by FIGS. 4 and 5.

In FIG. 4, the bindings are oriented in such a way that the rider has both feet directed toward the top of the drawing. The left-hand binding occupies a position which is set back as far as it will go relative to a central position, while the right-hand binding occupies a position which is as far forward as it will go relative to its central position. It is thus possible to make "fore-aft" adjustments.

In FIG. 5, left-hand binding, the ring 8 is placed in such a way that the binding occupies its position farthest to the left relative to the disk 7, that is to say its furthest forward position toward the tip of the board 6, whereas the right-hand binding occupies its position farthest to the right, that is say farthest set back toward the heel of the board. It is thus possible to adjust the separation between the feet. The range of adjustment of the bindings in the longitudinal direction of the board 6 is increased by the oblong holes 9.

The materials used for the boot binding, the disk and the ring are generally plastics materials.

The sets of teeth 16 and 21 could be replaced by simple rough surfaces or by an auxiliary friction ring.

What is claimed:

1. An assembly for securing a boot binding to a snowboard and for adjusting the position of the boot binding relative to the snowboard both in translation and rotation, the boot binding including a base plate having a circular opening extending through the base plate, the assembly comprising a circular disk adapted to be removably secured to an upper surface of the snowboard and a ring adapted to be received between the circular disk and the circular opening in the base plate with the circular disk retaining the ring and with the ring retaining the base plate when the assembly is secured to the snowboard, the ring having inner and outer circular circumferential surfaces which are radially spaced apart by a distance which varies circumferentially of the ring to form an eccentric member, both the inner circumferential surface of the ring and an outer circumferential surface of the circular disk being configured to define a plurality of angular positions of locking engagement of the ring relative to the circular disk, and both the outer circumferential surface of the ring and an inner circumferential surface of the circular opening in the base plate being configured to define a plurality of angular positions of locking engagement of the base plate relative to the ring.

2. The assembly as claimed in claim 1, wherein the disk has parallel oblong holes for fixing the disk to the board by using screws.

3. The device as claimed in claim 2, wherein the outer circumferential surface of the disk and the inner circumferentiar surface of the ring has sets of teeth of mating profiles cooperating to secure the disk and the ring against relative rotation.

4. The assembly as claimed in claim 2, wherein the outer circumferential surface of the ring has a set of teeth cooperating with a set of teeth on the inner circumferential surface of the circular opening in the base plate of the boot binding to hold the latter in terms of rotation relative to the ring.

5. The assembly as claimed in claim 1, wherein the outer circumferential surface of the disk and the inner circumferential surface of the ring has sets of teeth of mating profiles cooperating to secure the disk and the ring against relative rotation.

6. The assembly as claimed in claim 5, wherein the outer circumferential surface of the ring has a set of teeth cooperating with a set of teeth on the inner circumferential surface of the circular opening in the base plate of the boot binding to hold the latter in terms of rotation relative to the ring.

7. The device as claimed in claim 1, wherein the outer circumferential surface of the ring has a set of teeth cooperating with a set of teeth on the inner circumferential surface of the circular opening in the base plate of the boot binding to hold the latter in terms of rotation relative to the ring.

* * * * *